US009239549B1

(12) United States Patent
Ishii

(10) Patent No.: US 9,239,549 B1
(45) Date of Patent: Jan. 19, 2016

(54) CLEANING DEVICE HAVING DETECTION MECHANISM AND IMAGE FORMING APPARATUS INCLUDING SAME

(71) Applicant: FUJI XEROX CO., LTD., Minato-ku, Tokyo (JP)

(72) Inventor: Toru Ishii, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/615,747

(22) Filed: Feb. 6, 2015

(30) Foreign Application Priority Data

Sep. 10, 2014 (JP) ..... 2014-184350

(51) Int. Cl.
*G03G 21/00* (2006.01)
*G03G 15/16* (2006.01)

(52) U.S. Cl.
CPC ..... *G03G 15/161* (2013.01); *G03G 21/0011* (2013.01)

(58) Field of Classification Search
CPC ..... G03G 21/0011; G03G 2221/0089
USPC ..... 399/34, 350
See application file for complete search history.

(56) References Cited

U.S. PATENT DOCUMENTS 5,278,620 A * 1/1994 Godlove ..... 399/71
7,184,674 B2 * 2/2007 Satoh et al. ..... 399/34

FOREIGN PATENT DOCUMENTS

JP 3-267989 A 11/1991
JP 2010-151900 A 7/2010
JP 2011-112665 A 6/2011
JP 2013231929 A * 11/2013
JP 2013250469 A * 12/2013

* cited by examiner

*Primary Examiner* — Robert Beatty
(74) *Attorney, Agent, or Firm* — Sughrue Mion, PLLC

(57) ABSTRACT

A cleaning device includes a cleaning member that has a plate shape and cleans an outer circumference surface of a revolving cleaning target member with one end side of the cleaning member coming into contact with the outer circumference surface by removing adhering substances adhering to the outer circumference surface, and a detection mechanism that is attached to an end surface of the other end side of the cleaning member and detects vibration of the cleaning member.

11 Claims, 7 Drawing Sheets

CLEANING DEVICE HAVING DETECTION MECHANISM AND IMAGE FORMING APPARATUS INCLUDING SAME

CROSS-REFERENCE TO RELATED APPLICATIONS

This application is based on and claims priority under 35 USC 119 from Japanese Patent Application No. 2014-184350 filed Sep. 10, 2014.

BACKGROUND

Technical Field

The present invention relates to a cleaning device and an image forming apparatus.

SUMMARY

According to an aspect of the invention, there is provided a cleaning device including:

a cleaning member that has a plate shape and cleans an outer circumference surface of a revolving cleaning target member with one end side of the cleaning member coming into contact with the outer circumference surface by removing adhering substances adhering to the outer circumference surface; and a detection mechanism that is attached to an end surface of the other end side of the cleaning member and detects vibration of the cleaning member.

BRIEF DESCRIPTION OF THE DRAWINGS

Exemplary embodiments of the present invention will be described in detail based on the following figures, wherein.

DETAILED DESCRIPTION

Figure 1A:
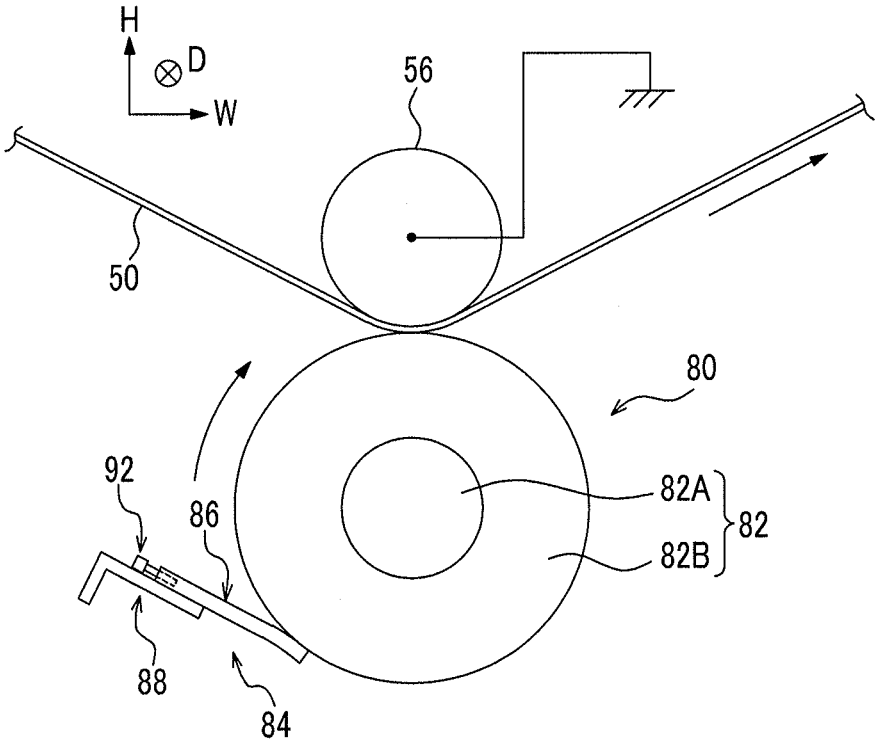
FIGS. 1A and 1B are a side view and an enlarged side view illustrating a cleaning device and a secondary transfer roll according to an exemplary embodiment of the invention.

An example of a cleaning device and an image forming apparatus according to an exemplary embodiment of the invention will be described with reference to FIGS. 1A to 6B. In the drawings, an arrow H indicates an upward and downward direction (perpendicular direction) of the device (apparatus), an arrow W indicates a width direction (horizontal direction) of the device (apparatus), and an arrow D indicates a depth direction (horizontal direction) of the device (apparatus).

Figure 5:
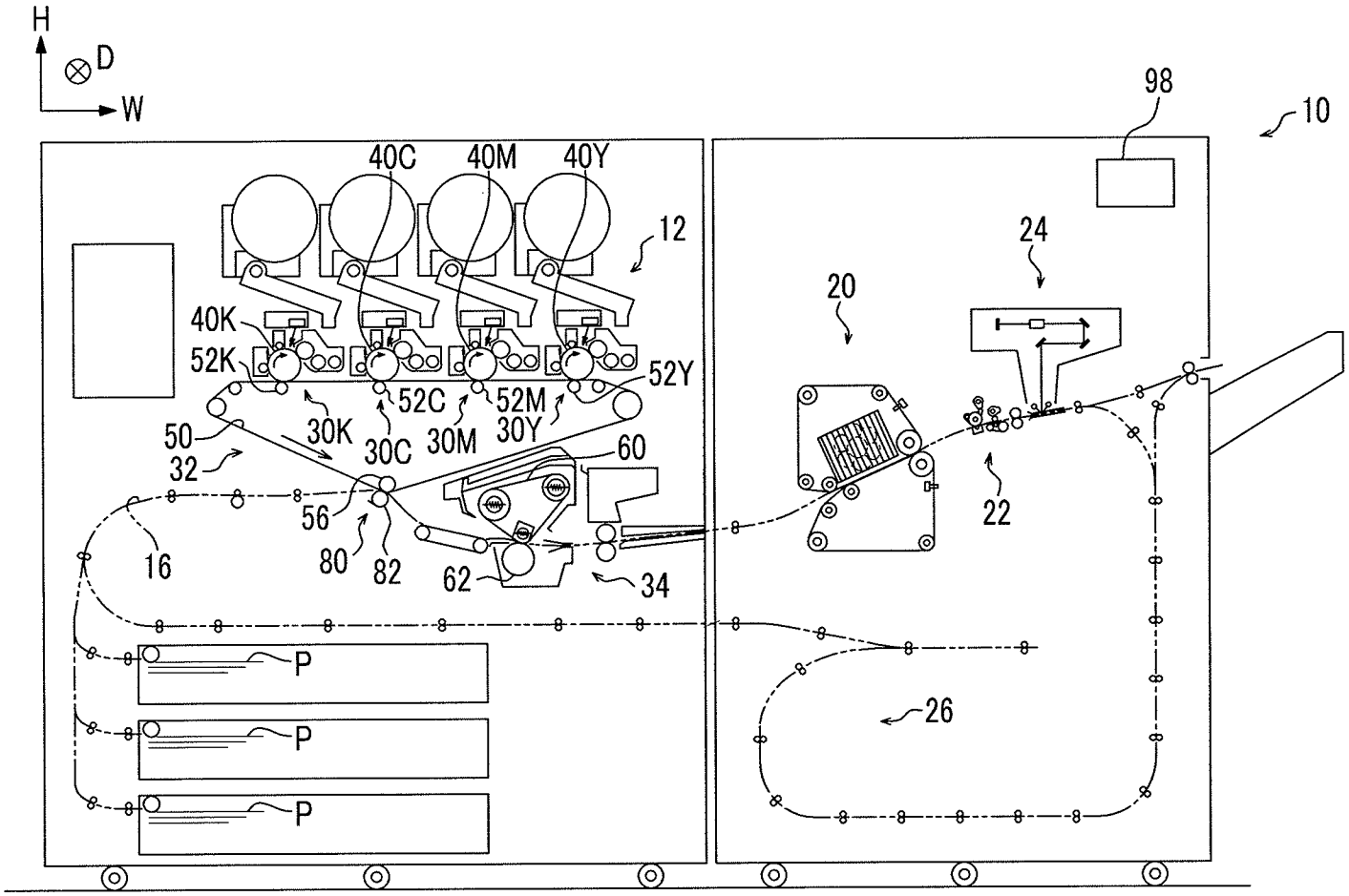
FIG. 5 is a schematic structural diagram illustrating the image forming apparatus according to the exemplary embodiment of the invention.

As illustrated in FIG. 5, an image forming apparatus 10 includes an image forming section 12 (an example of an image forming member) and plural transporting members (reference numeral omitted). The image forming section 12 forms a toner image through an electrophotographic process. The transporting member transports a sheet member P (an example of a recording medium) on which the toner image is formed, along a transporting path 16 of the sheet member P.

The image forming apparatus 10 includes a cooling section 20, a straightening section 22, and an image inspection section 24. The cooling section 20 cools the sheet member P on which the toner image is formed. The straightening section 22 straightens the crooked sheet member P and the image inspection section 24 inspects the image formed on the sheet member P.

The image forming apparatus 10 includes a reversal path 26 for inverting the sheet member P of which an image is formed on a surface and transporting the inverted sheet member P toward the image forming section 12 again in order to form images on both sides of the sheet member P.

As illustrated in FIG. 5, the image forming section 12 includes plural toner image forming sections 30Y, 30M, 30C, and 30K and a transfer section 32. The toner image forming sections 30Y, 30M, 30C, and 30K respectively form toner images with colors different from each other. The transfer section 32 transfers toner images formed by the toner image forming sections 30 to the sheet member P. The image forming section 12 includes a fixing device 34 that fixes the toner images transferred to the sheet member P by the transfer section 32 on the sheet member P. In the exemplary embodiment, the toner image forming sections 30 of a total of four colors, that is, yellow (Y), magenta (M), cyan (C), and black (K) are included. The marks of (Y), (M), (C), and (K) illustrated in the drawings respectively indicate the colors.

The toner image forming sections 30Y, 30M, 30C, and 30K corresponding to the respective colors are disposed along a transfer belt 50 that is included in the transfer section 32 and revolves. The yellow (Y) toner image forming section 30Y, the magenta (M) toner image forming section 30M, the cyan (c) toner image forming section 30C, and the black (K) toner image forming section 30K are disposed in this order from an upstream side in a revolving direction (see arrow in FIG. 5) of the transfer belt 50 and are arranged in a horizontal direction. In the following description, the marks of Y, M, C, and K which are attached to the reference numerals are omitted when distinction between the colors of yellow (Y), magenta (M), cyan (C), and black (K) is not required.

Figure 4:
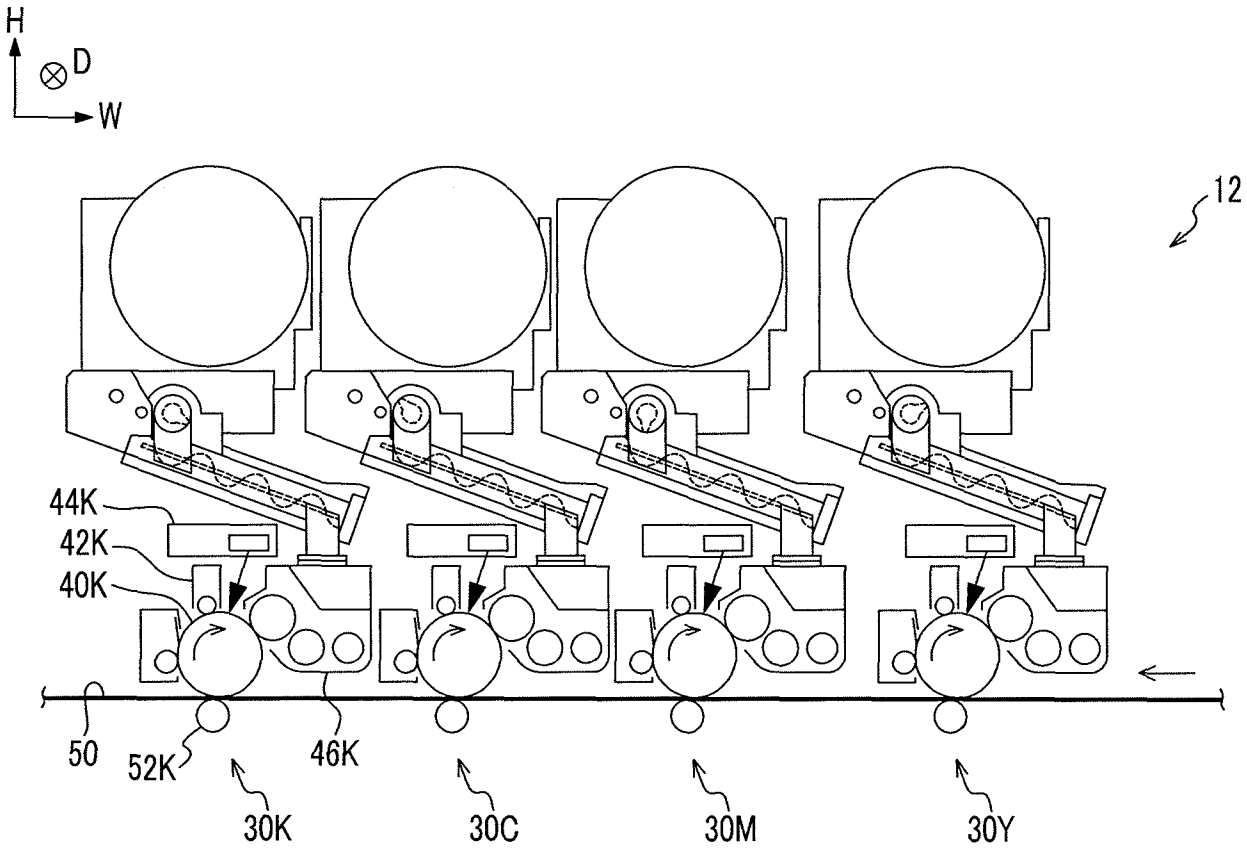
FIG. 4 is a structural diagram illustrating an image forming section of an image forming apparatus according to the exemplary embodiment of the invention.

The toner image forming sections 30 corresponding to the respective colors have the same basic configuration except for a toner to be used. As illustrated in FIG. 4, each of the toner image forming sections 30 includes a photosensitive drum 40 which has a cylindrical shape and rotates and a charging device 42 which causes the photosensitive drum 40 to be charged. Each of the toner image forming sections 30 further includes an exposure device 44 and a developing device 46. The exposure device 44 irradiates the charged photosensitive drum 40 with exposure light to form an electrostatic latent image. The developing device 46 develops the electrostatic latent image as a toner image by using a developer G including a toner. The photosensitive drums 40 corresponding to the respective colors come into contact with the revolving transfer belt 50.

As illustrated in FIG. 5, the transfer section 32 includes the transfer belt 50 which is wound up by plural rolls (reference numerals omitted) and revolves in a direction indicated by the arrow in FIG. 5 and primary transfer rolls 52 which are respectively disposed on a side opposite to the photosensitive drums 40 corresponding to the respective colors with the transfer belt 50 interposed therebetween. The primary transfer roll 52 transfers the toner image formed on the photosensitive drum 40 to the transfer belt 50.

The transfer section 32 further includes an assist roll 56 and a transfer device 80. The transfer belt 50 is wound around the assist roll 56. The transfer device 80 is disposed on a side opposite to the assist roll 56 based on the transfer belt 50 and transfers the toner image on the transfer belt 50 to the sheet member P. The assist roll 56 is grounded, as illustrated in FIG. 1A. The transfer device 80 includes a secondary transfer roll 82 (an example of a cleaning target member) and a cleaning device 84. The secondary transfer roll 82 is disposed on a side opposite to the assist roll 56 and rotates (revolves) in a direction (clockwise direction) indicated by an arrow in FIG. 1A. A transfer voltage is applied to the secondary transfer roll 82. The cleaning device 84 cleans an outer circumference surface of the secondary transfer roll 82 by removing adhering substances which adhere to the outer circumference surface. The transfer device 80 will be described in detail later.

The fixing device 34 includes a fixation belt 60 and a pressure roll 62, as illustrated in FIG. 5. The fixation belt 60 is wound up by plural rolls (reference numeral omitted) and is heated and the pressure roll 62 presses the sheet member P toward the fixation belt 60.

In the image forming apparatus 10 having the above-described configuration, as illustrated in FIG. 4, the charging device 42 causes the rotating photosensitive drum 40 to be charged, the exposure device 44 irradiates the charged photosensitive drum 40 with the exposure light to form the electrostatic latent image in each of the toner image forming sections 30 corresponding to the respective colors. The developing device 46 develops the electrostatic latent image formed on the photosensitive drum 40 as a toner image by using the developer G.

As illustrated in FIG. 5, in the transfer section 32, each primary transfer roll 52 transfers a toner image formed on each photosensitive drum 40 to the transfer belt 50 (the primary transfer rolls and the photosensitive drums 40 are respectively assigned to the colors). The secondary transfer roll 82 transfers the toner image formed on the transfer belt 50 to a surface of the sheet member P. In the fixing device 34, the sheet member P to which the toner image is transferred is nipped by the revolving fixation belt 60 and the pressure roll 62, and thus the toner image is fixed on the sheet member P.

The sheet member P on which the toner image is fixed passes through the cooling section 20, the straightening section 22, and the image inspection section 24 in this order to be caused to exit to the outside of the image forming apparatus.

When a toner image is formed on a back surface of the sheet member P, the sheet member P of which the toner image is formed on the surface is inverted by transferring the sheet member P along the reversal path 26 and a toner image is formed again on the back surface of the sheet member P in the image forming section 12.

Main Configuration

The transfer device 80 will be described.

The transfer device 80 includes the secondary transfer roll 82 which is disposed on a side opposite to the assist roll 56 with the transfer belt 50 interposed between the secondary transfer roll 82 and the assist roll 56 and the cleaning device which cleans the outer circumference surface of the secondary transfer roll 82 by removing adhering substances which adhere to the outer circumference surface, as illustrated in FIG. 1A.

Secondary Transfer Roll

The secondary transfer roll 82 is rotatably supported by a frame member (not illustrated) with the depth direction of the device set as an axial direction. The secondary transfer roll 82 includes a metal shaft portion 82A and a cylindrical elastic portion 82B through which the shaft portion 82A passes. The outer diameter of the elastic portion 82B is set to approximately 30 mm and the length of the elastic portion 82B in the depth direction of the device is set to approximately 360 mm. The secondary transfer roll 82 is driven by the revolving transfer belt 50 to rotate (revolve) at the same revolving speed as that of the transfer belt 50.

Cleaning Device

Figure 1B:
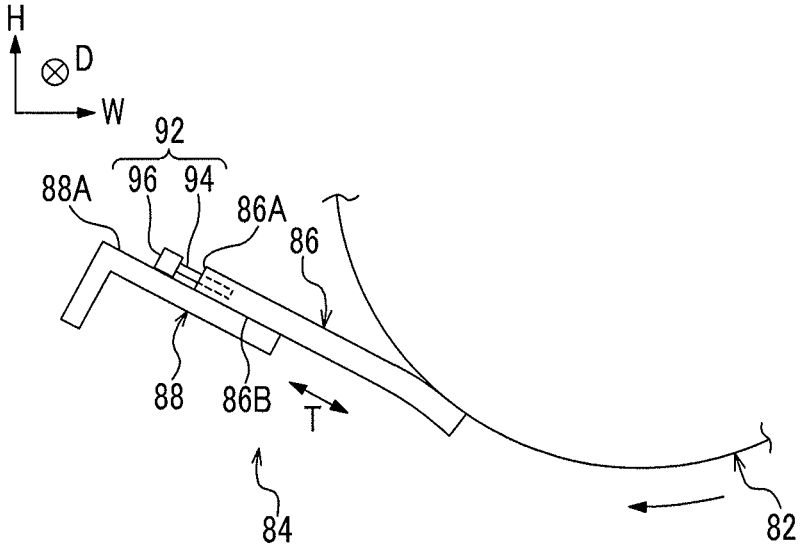

The cleaning device 84 includes a scratch blade 86 (an example of the cleaning member) and a support plate 88, as illustrated in FIG. 1B. The scratch blade 86 has a plate shape and scratches (removes) adhering substances which adhere to the outer circumference surface of the secondary transfer roll 82 (an example of the cleaning target member) and the support plate 88 supports the scratch blade 86. The cleaning device 84 includes a detection mechanism 92 which detects vibration of the scratch blade 86.

The scratch blade 86 is formed by using polyurethane. The scratch blade 86 is set to 2 mm in thickness, set to 335 mm in length in the depth direction of the device, and set to 15 mm in width. A distal end side (a right side in FIG. 1B, an example of one end side) of the scratch blade 86 comes into contact with the outer circumference surface of the secondary transfer roll 82 and a proximal end side (a left side in FIG. 1B, an example of the other end side) of the scratch blade 86 is supported by the support plate 88. The distal end side of the scratch blade 86 is bent to an outside of the secondary transfer roll 82 in a radial direction in a state where the distal end side of the scratch blade 86 comes into contact with the outer circumference surface of the secondary transfer roll 82. Accordingly, the distal end portion of the scratch blade 86 and a plate surface of the scratch blade 86 come into contact with the outer circumference surface of the secondary transfer roll 82.

The support plate 88 is a bent metal plate. A plate surface 86B of the scratch blade 86 which faces downward on the proximal end side of the scratch blade 86 and a plate surface 88A of the support plate 88 which faces upward are attached to each other by using an adhesive. Accordingly, the support plate 88 supports the proximal end side of the scratch blade 86 to be upward. The support plate 88 is attached to the frame member (not illustrated).

Figure 2A:
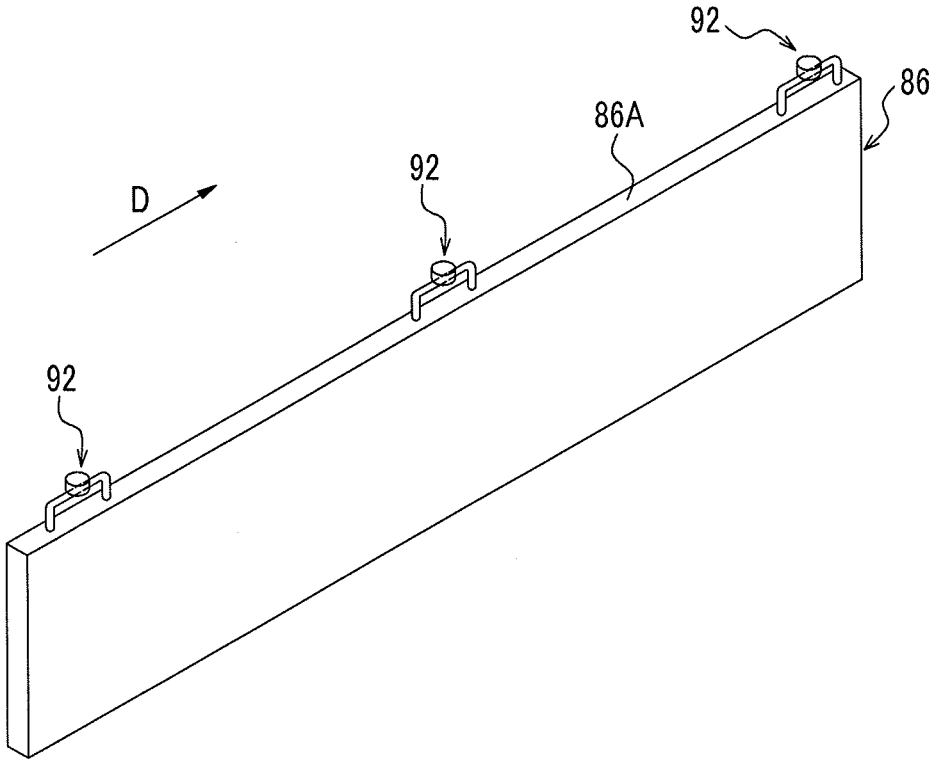
FIGS. 2A and 2B are a perspective view and an enlarged perspective view illustrating a detection mechanism and a scratch blade included in the cleaning device according to the exemplary embodiment of the invention.
Figure 2B:
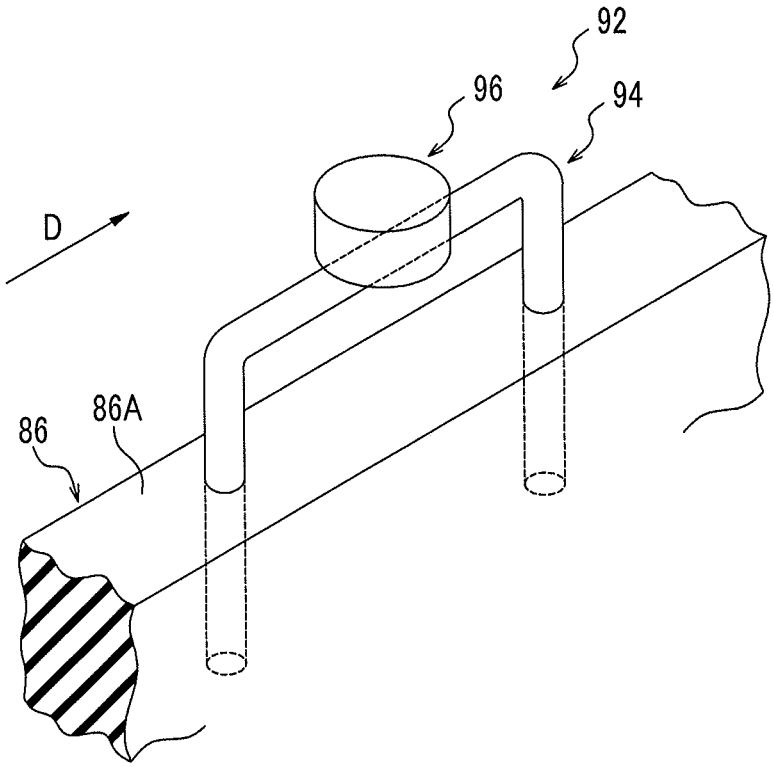

The detection mechanism 92 is attached to an end surface 86A of the proximal end side of the scratch blade 86. As illustrated in FIG. 2A, three detection mechanisms 92 are provided at a distance in the depth direction of the device. The detection mechanism 92 includes an insertion member 94 of which a portion is inserted into the scratch blade 86 through the end surface 86A, as illustrated in FIG. 2B. The detection mechanism 92 includes a detection member 96 that is attached to a portion of the insertion member 94, which is exposed (protrudes) from the end surface 86A and that detects vibration of the insertion member 94. The detection mechanism 92 being attached to the end surface 86A of the scratch blade 86 means the following two states. One is a state where the detection mechanism 92 is attached (the detection member 96 and the end surface 86A do not directly come into contact with each other) in a state in which the detection member 96 detecting vibration faces the end surface 86A in a plate surface direction (a direction indicated by an arrow T in FIG. 1B) of the scratch blade 86 in the detection mechanism 92. The other is a state where the detection mechanism 92 is attached in a state in which the detection member 96 comes into contact with the end surface 86A.

In detail, the insertion member 94 has a U shape and portions of the insertion member 94 on both end sides of the insertion member 94 are inserted into the scratch blade 86 through the end surface 86A. A bottom surface of the detection member 96 is attached to a portion of the insertion member 94 which is exposed from the end surface 86A and is positioned on a center side of the insertion member 94 by using an adhesive or the like. The detection member 96 is disposed to face the end surface 86A. A detection direction when the detection member 96 detects vibration is set to the plate surface direction of the scratch blade 86.

In the configuration, when the scratch blade 86 scratches adhering substances which adhere to the outer circumference surface of the secondary transfer roll 82, a stick-slip phenomenon occurs between the outer circumference surface of the revolving secondary transfer roll 82 and the distal end side of the scratch blade 86 and the scratch blade 86 vibrates at a frequency of approximately 4,000 [Hz] in the plate surface direction (direction indicated by the arrow T in FIG. 1B). The stick-slip phenomenon means a phenomenon in which a frictional force is generated between the outer circumference surface of the revolving secondary transfer roll 82 and the distal end side of the scratch blade 86 and the outer circumference surface of the secondary transfer roll 82 and the distal end side of the scratch blade 86 repeatedly become stuck to each other and slip due to the generated frictional force.

The vibration in the plate surface direction occurring on the scratch blade 86 is detected by the detection member 96 through the insertion member 94. In other words, the vibration in the plate surface direction occurring on the scratch blade 86 is detected by the detection mechanism 92.

The distal end side of the scratch blade 86 may be damaged gradually if the scratch blade 86 vibrates due to the frictional force occurring between the outer circumference surface of the secondary transfer roll 82 and the distal end side of the scratch blade 86 when the scratch blade 86 comes into contact with the outer circumference surface of the revolving secondary transfer roll 82.

Others

The image forming apparatus 10 includes a user interface 98 (an example of a notification unit) (see FIG. 5). The user interface 98 notifies a user that it is time to replace the cleaning device 84 by performing display on a screen when a result obtained by detection of the detection mechanism 92 reaches a threshold which will be described later. Specifically, a control section (not illustrated) controls the user interface 98 to display that it is time to replace the cleaning device 84 based on a detection result of the detection mechanism 92.

A timing at which the user interface 98 displays that it is time to replace the cleaning device 84 will be described along with the effect which will be described later.

Effect

The effect of the cleaning device 84 according to the exemplary embodiment will be described while being compared to a cleaning device 200 according to a comparative embodiment.

Figure 6A:
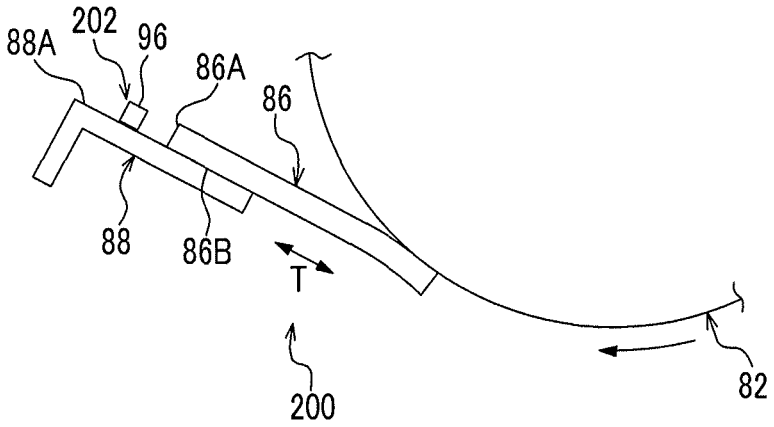
FIG. 6A is a side view illustrating a cleaning device according to a comparative embodiment of the exemplary embodiment of the invention.

The cleaning device 200 according to the comparative embodiment includes a detection mechanism 202. The detection member 96 of the detection mechanism 202 is attached to the plate surface 88A of the support plate 88 by using an adhesive or the like instead of being attached to the end surface 86A of the scratch blade 86, as illustrated in FIG. 6A. The plate surface 88A of the support plate 88 is a surface to which the scratch blade 86 is attached. In this manner, the detection mechanism 202 does not include the insertion member 94 and the detection member 96 of the detection mechanism 202 is directly attached to the plate surface 88A of the support plate 88. The detection direction when the detection member 96 of the detection mechanism 202 detects the vibration is the same as that of the detection mechanism 92 and is parallel to the plate surface direction of the scratch blade 86.

Figure 6B:
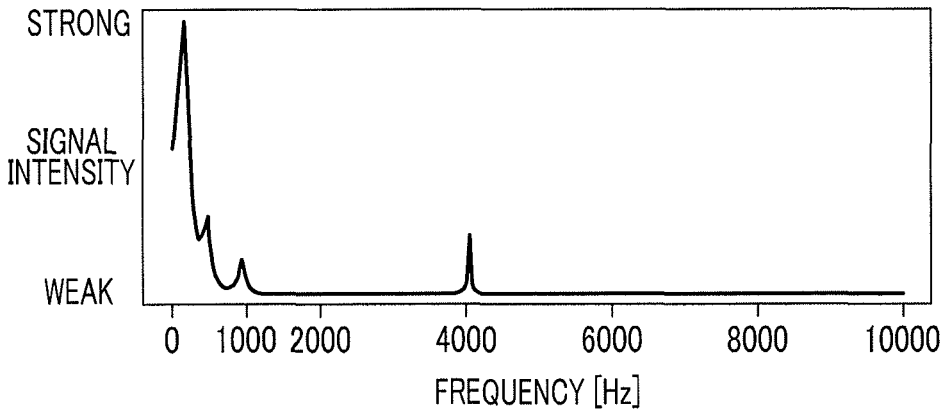
FIG. 6B is a graph illustrating vibration detected by using the cleaning device according to the comparative embodiment.

FIG. 6B illustrates a graph of a frequency spectrum of the vibration detected by the detection mechanism 202 of the cleaning device 200 according to the comparative embodiment. A horizontal axis of the graph in FIG. 6B indicates a frequency [Hz] of the detected vibration. A vertical axis of the graph in FIG. 6B indicates signal intensity of the detected vibration. The frequency of the scratch blade 86 vibrating in the plate surface direction is approximately 4,000 [Hz] when the scratch blade 86 scratches adhering substances which adhere to the outer circumference surface of the secondary transfer roll 82, as described above.

As illustrated in the graph of FIG. 6B, according to the result obtained by detection of the detection mechanism 202, the signal intensity of the vibration at a frequency of equal to or less than 1,000 [Hz] is stronger than the signal intensity of the vibration at a frequency of approximately 4,000 [Hz]. The vibration at a frequency of equal to or less than 1,000 [Hz] refers to vibration of the support plate 88. Accordingly, the detection mechanism 202 clearly detects the vibration of the support plate 88 compared to the vibration of the scratch blade 86.

Figure 3A:
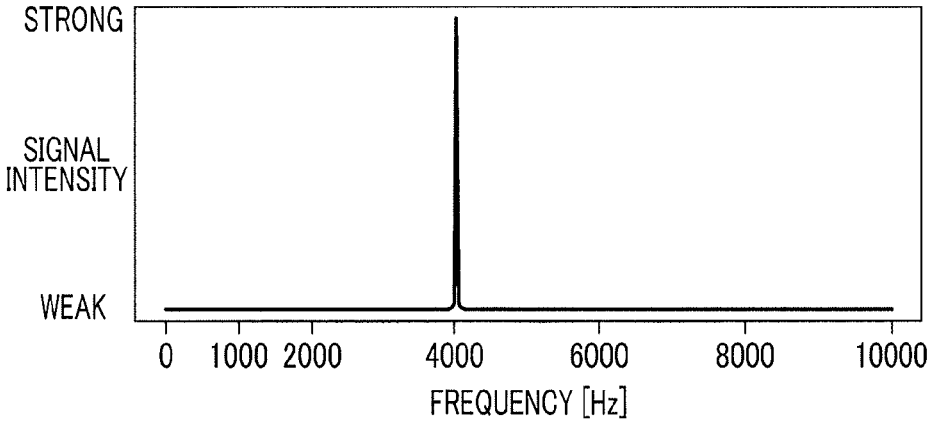
FIGS. 3A and 3B are graphs illustrating vibration detected by the detection mechanism included in the cleaning device according to the exemplary embodiment of the invention.

FIG. 3A illustrates a graph of a frequency spectrum of the vibration detected by the detection mechanism 92 of the cleaning device 84 according to the exemplary embodiment. A horizontal axis of the graph in FIG. 3A indicates a frequency [Hz] of the detected vibration. A vertical axis of the graph in FIG. 3A indicates signal intensity of the detected vibration.

As illustrated in the graph of FIG. 3A, according to the result obtained by detection of the detection mechanism 92, the vibration at a frequency of equal to or less than 1,000 [Hz] is not detected and the vibration at a frequency of approximately 4,000 [Hz] is detected. That is, the vibration of the support plate 88 is not detected and the vibration of the scratch blade 86 is detected.

An operation of the user interface 98 included in the image forming apparatus 10 according to the exemplary embodiment will be described.

Figure 3B:
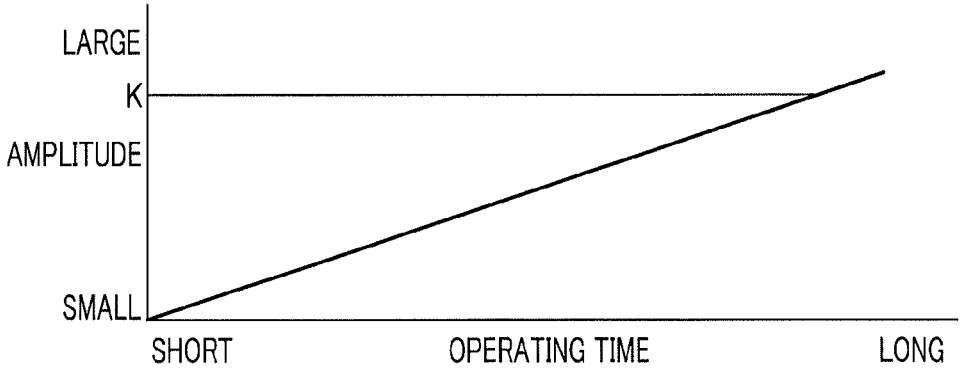

FIG. 3B illustrates a graph of amplitude of the vibration of the scratch blade 86 detected by the detection mechanism 92. A horizontal axis of the graph in FIG. 3B indicates an operating time of the secondary transfer roll 82. A vertical axis of the graph in FIG. 3B indicates the amplitude of the vibration of the scratch blade 86.

As illustrated in the graph of FIG. 3B, as the operating time of the secondary transfer roll 82 is long, the amplitude of the vibration of the scratch blade 86 becomes large. It is considered that this is because the distal end side of the scratch blade 86 is damaged by the frictional force occurring between the outer circumference surface of the revolving secondary transfer roll 82 and the distal end side of the scratch blade 86. That is, the scratch blade 86 becomes damaged greatly when the amplitude is large, compared to when the amplitude is small.

If the amplitude reaches a predetermined threshold K (see FIG. 3B), the user interface 98 displays that it is time to replace the cleaning device 84. Regarding that the amplitude reaches the threshold K, in order not to detect an abnormal amplitude, the user interface 98 displays that it is time to replace the cleaning device 84 when all of the amplitudes, each of a vibration which is detected by a unit time, reach the threshold K.

CONCLUSION

As described above, in the cleaning device 84, the detection mechanism 92 is attached to the end surface 86A of the scratch blade 86 and thus detection accuracy in detecting vibration of the scratch blade 86 due to contact with the outer circumference surface of the revolving secondary transfer roll 82 is improved, compared to the cleaning device 200 according to the comparative embodiment. This is because the detection mechanism 92 is attached to the end surface 86A of the scratch blade 86 and thus the vibration of the scratch blade 86 in the plate surface direction is directly transmitted to the detection mechanism 92.

In the cleaning device 84, the portions of the insertion member 94 constituting the detection mechanism 92 are inserted into the scratch blade 86 through the end surface 86A. Accordingly, the vibration in the scratch blade 86 is detected by the detection member 96 through the insertion member 94.

The detection accuracy in detecting the vibration of the scratch blade 86 is improved by the detection member 96 detecting the vibration in the scratch blade 86 through the insertion member 94, compared to when a portion of the insertion member is not inserted into the scratch blade 86 through the end surface 86A.

When the detection member 96 does not directly come into contact with the end surface 86A, that is, when an exposed portion of the insertion member 94 is present between the scratch blade 86 and the detection member 96, the vibration of the scratch blade 86 is amplified at the exposed portion of the insertion member 94 to be transmitted to the detection member 96 and thus a proportion of detection of vibration is improved, compared to when the insertion member 94 is not exposed between the scratch blade 86 and the detection member 96 (when the detection mechanism 92 is attached in a state where the detection member 96 comes into contact with the end surface 86A).

In the image forming apparatus 10, the user interface 98 displays that it is time to replace the cleaning device 84. A user sees this display and performs replacement of the cleaning device 84. Accordingly, adhering substances which adhere to the outer circumference surface of the secondary transfer roll 82 are suppressed from remaining on the outer circumference surface of the secondary transfer roll 82.

In the image forming apparatus 10, degradation in image quality of an output image occurring due to adhering substances remaining on the outer circumference surface of the secondary transfer roll 82 is suppressed by suppressing the adhering substances from remaining on the outer circumference surface of the secondary transfer roll 82.

A specific exemplary embodiment for the invention is described in detail. However, the invention is not limited to the above-described exemplary embodiment and it is apparent for those skilled in the related art that various exemplary embodiments may be obtained within a scope of the invention. For example, in the above-described exemplary embodiment, an example in which the secondary transfer roll 82 is set as a cleaning target member to be cleaned by the cleaning device 84 is described. However, the cleaning device 84 may be used for removing adhering substances such as remaining toner which adheres to the photosensitive drum 40 (one example of the image holding member) that holds a toner image or the transfer belt 50 (another example of the image holding member) that holds a toner image. Accordingly, degradation in image quality of an output image occurring due to adhering substances such as remaining toner which adheres to the photosensitive drum 40 or the transfer belt 50 is suppressed.

In the above-described exemplary embodiment, the user interface 98 displays on the screen that it is time to replace the cleaning device 84. However, the user interface displays on the screen that it is time to replace the secondary transfer roll 82 when it is recognized in advance that the secondary transfer roll 82 (cleaning target member) is damaged by the frictional force occurring between the outer circumference surface of the revolving secondary transfer roll 82 and the distal end side of the scratch blade 86.

In the above-described exemplary embodiment, the user interface 98 notifies a user that it is time to replace the cleaning device 84 by performing display on the screen. However, the user interface 98 may notify the user that it is time to replace the cleaning device 84 by using sound and the like.

In the above-described exemplary embodiment, a user is notified that it is time to replace the cleaning device 84 by using the user interface 98. However, the control section and the like included in the image forming apparatus 10 may notify a management company which manages the image forming apparatus 10, and the like that it is time to replace the cleaning device 84 through the Internet and the like.

In the above-described exemplary embodiment, the amplitude of the vibration of the scratch blade 86 is used as a threshold for determining that it is time to replace the cleaning device 84. However, variation in frequency within a unit time and the like may be used as the threshold. This is because as damage of the scratch blade 86 becomes severe, the variation in frequency within a unit time becomes large.

In the above-described exemplary embodiment, the distal end side of the scratch blade 86 faces toward an upstream side in the rotation direction of the secondary transfer roll 82, compared to the proximal end side of the scratch blade 86 (so-called a doctor blade). However, the distal end side of the scratch blade 86 may face toward a downstream side in the rotation direction of the secondary transfer roll 82, compared to the proximal end side of the scratch blade 86 (so-called a wiper blade).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a support plate;

a cleaning member having a plate shape, configured to clean an outer circumference surface of a cleaning target member with a first end of the cleaning member coming into contact with the outer circumference surface and configured to remove adhering substances adhering to the outer circumference surface, the cleaning member having a first surface, the first surface supported on the support plate; and a detection mechanism that is attached to an end surface of a second end opposite to the first end of the cleaning member and configured to detect vibration of the cleaning member, the end surface of the cleaning member extending in an intersecting direction of the first surface.

2. The cleaning device according to claim 1, wherein the detection mechanism extends in a direction which is parallel with a direction extending from the one end side of the cleaning member toward the other end side of the cleaning member.

3. An image forming apparatus comprising:

an image holding member configured to hold an image;

the cleaning device according to claim 1 configured to remove adhering substances adhering to the image holding member; and a notification unit configured to perform notification that it is time to replace at least one of the cleaning device and the image holding member when a detection result reaches a threshold, the detection result being obtained by the detection mechanism included in the cleaning device.

4. An image forming apparatus comprising:

an image holding member configured to hold an image;

a transfer member configured to transfer the image held by the image holding member to a recording medium;

the cleaning device according to claim 1 configured to remove adhering substances adhering to the transfer member; and a notification unit configured to perform notification that it is time to replace at least one of the cleaning device and the transfer member, based on a detection result obtained by the detection mechanism included in the cleaning device.

5. The image forming apparatus according to claim 3, wherein the threshold is an amplitude of vibration or variation in frequency within a unit time of the cleaning member.

6. A cleaning device comprising:

a cleaning member having a plate shape, configured to clean an outer circumference surface of a cleaning target member with a first end of the cleaning member coming into contact with the outer circumference surface and configured to remove adhering substances adhering to the outer circumference surface; and a detection mechanism that is attached to an end surface of a second end opposite to the first end of the cleaning member and configured to detect vibration of the cleaning member, the detection member comprising:

an insertion member of which a portion is inserted into the cleaning member through the end surface; and a detection member that is attached to a portion of the insertion member exposed from the end surface, disposed to face the end surface and detects vibration of the insertion member.

7. The cleaning device according to claim 6, wherein the detection member is attached in such a manner that the exposed portion of the insertion member is present between the detection member and the cleaning member.

8. The cleaning device according to claim 6, wherein the detection mechanism extends in a direction which is parallel with a direction extending from the one end side of the cleaning member toward the other end side of the cleaning member.

9. The cleaning device according to claim 7, wherein the detection mechanism extends in a direction which is parallel with a direction extending from the one end side of the cleaning member toward the other end side of the cleaning member.

10. An image forming apparatus comprising:

an image holding member configured to hold an image;

the cleaning device according to claim 6 configured to remove adhering substances adhering to the image holding member; and a notification unit configured to perform notification that it is time to replace at least one of the cleaning device and the image holding member when a detection result reaches a threshold, the detection result being obtained by the detection mechanism included in the cleaning device.

11. An image forming apparatus comprising:

an image holding member configured to hold an image;

a transfer member configured to transfer the image held by the image holding member to a recording medium;

the cleaning device according to claim 6 configured to remove adhering substances adhering to the transfer member; and a notification unit configured to perform notification that it is time to replace at least one of the cleaning device and the transfer member, based on a detection result obtained by the detection mechanism included in the cleaning device.

* * * * *